US009724579B1

(12) United States Patent
Allen

(10) Patent No.: US 9,724,579 B1
(45) Date of Patent: Aug. 8, 2017

(54) SOFT TOSS GAME APPARATUS AND METHOD OF PLAYING GAME

(71) Applicant: Christopher Allen, Charlotte, NC (US)

(72) Inventor: Christopher Allen, Charlotte, NC (US)

( * ) Notice: Subject to any disclaimer, the term of this patent is extended or adjusted under 35 U.S.C. 154(b) by 0 days.

(21) Appl. No.: 15/069,871

(22) Filed: Mar. 14, 2016

Related U.S. Application Data

(60) Provisional application No. 62/132,711, filed on Mar. 13, 2015.

(51) Int. Cl.
*A63B 67/06* (2006.01)
*A63B 63/08* (2006.01)
*A63B 63/00* (2006.01)

(52) U.S. Cl.
CPC ..... *A63B 67/06* (2013.01); *A63B 63/08* (2013.01); *A63B 63/00* (2013.01); *A63B 2210/50* (2013.01)

(58) Field of Classification Search
CPC ..... A63F 2250/205; A63B 67/06; A63B 2067/061; A63B 63/08; A63B 2210/50; A63B 2225/605; A63B 63/00; A63B 67/007
USPC ..... 273/398–402, 350
See application file for complete search history.

(56) References Cited

U.S. PATENT DOCUMENTS 2,183,107 A 12/1939 Savage
2,988,361 A 6/1961 Dart
3,351,344 A * 11/1967 Dupuy ..... A63B 63/08 273/400
3,843,124 A * 10/1974 Davis ..... A63B 67/06 273/398
4,392,653 A 7/1983 Blume, Sr.
4,717,156 A * 1/1988 Wright ..... A63B 67/06 273/401
5,052,693 A 10/1991 Hicks
5,110,139 A * 5/1992 Baumgartner ..... A63B 67/06 273/400
5,123,656 A 6/1992 Green
5,382,028 A * 1/1995 Sciandra ..... A63B 67/06 273/401

(Continued)

OTHER PUBLICATIONS

Information Disclosure Statement (IDS) Letter Regarding Common Patent Application(s), dated Apr. 11, 2016.

(Continued)

*Primary Examiner* — Mark Graham
(74) *Attorney, Agent, or Firm* — Tillman Wright, PLLC; James D. Wright; David R. Higgins

(57) ABSTRACT

A method of playing a soft toss game utilizes a collapsible target structure. The method includes transporting the structure, which includes a plurality of bucket components, to a desired location. Each bucket component includes an outer wall, a bottom surface, and an open area at the top of the outer wall that is large enough to receive any of a plurality of tossable objects when tossed by a player. During transport, the bucket components are nested within one another. At the desired location, the bucket components are assembled in a stack. A first player tosses a first of the plurality of tossable objects in the general direction of the stack. A score is determined a score for the first player based on where the object lands relative to the stack. These steps are repeated until the game is completed. Then the bucket components are disassembled and re-nested within one another.

20 Claims, 12 Drawing Sheets

(56) References Cited

U.S. PATENT DOCUMENTS

D375,529 S * 11/1996 Kohler ..... D21/303
5,620,185 A * 4/1997 Robertson ..... A63B 67/06 273/338
5,707,062 A * 1/1998 Perillo ..... A63B 63/08 273/354
5,732,952 A * 3/1998 Joseph ..... A63B 63/08 273/317.6
6,173,957 B1 * 1/2001 James, Sr. ..... A63B 63/08 273/350
6,669,200 B1 * 12/2003 Knetsch ..... A63B 67/06 273/400
7,134,662 B2 11/2006 Menendez
7,500,674 B2 * 3/2009 Riley ..... A63B 67/06 273/126 R
8,550,014 B1 10/2013 Mariani
2002/0175469 A1 * 11/2002 Kessler, Jr. ..... A63B 67/06 273/400
2004/0003760 A1 1/2004 O'Connell Cooper et al.
2004/0178584 A1 * 9/2004 Fairbanks ..... A63B 67/06 273/400
2005/0051968 A1 * 3/2005 Froesel ..... A63B 67/06 273/336
2009/0200742 A1 * 8/2009 Maietta ..... A63B 63/08 273/401
2010/0320692 A1 12/2010 Tookey
2012/0169012 A1 7/2012 Parker et al.
2012/0319354 A1 * 12/2012 Fusco ..... A63B 63/08 273/398
2014/0015198 A1 1/2014 Francis
2014/0091525 A1 * 4/2014 Ramirez ..... A63B 63/08 273/402
2015/0061225 A1 * 3/2015 Sciandra ..... A63B 67/06 273/400
2015/0246280 A1 * 9/2015 Shea ..... A63F 9/02 273/350
2015/0265894 A1 * 9/2015 Weber ..... A63B 67/06 273/400

OTHER PUBLICATIONS

The Chickabug Blog, "Golf Party:Charlie is 1!," available at http://blog.chickabug.com/2012/08golf-first-birthday-party.html, posted Aug. 6, 2012 (11 pages).

* cited by examiner

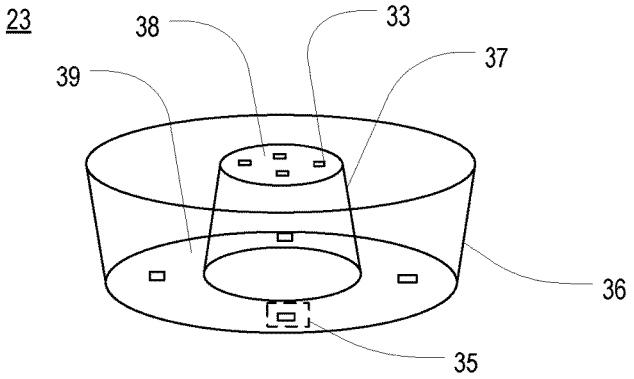
FIG. 8B
FIG. 8C
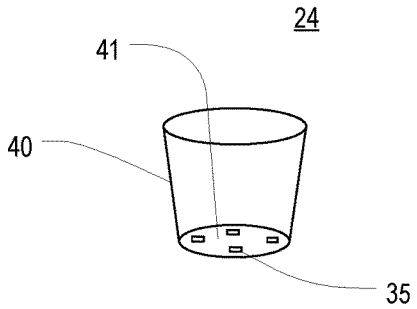
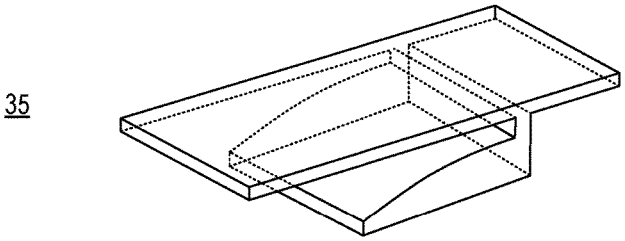
FIG. 8E

SOFT TOSS GAME APPARATUS AND METHOD OF PLAYING GAME

CROSS-REFERENCE TO RELATED APPLICATION

The present application is a U.S. non-provisional patent application of, and claims priority under 35 U.S.C. §119(e) to, U.S. provisional patent application Ser. No. 62/132,711, filed Mar. 13, 2015 and entitled "SOFT TOSS GAME APPARATUS AND METHOD OF PLAYING GAME," the entirety of which is expressly incorporated by reference herein.

COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

BACKGROUND OF THE PRESENT INVENTION

Field of the Present Invention

The present invention relates generally to games, and, in particular, to games involving small objects such as beanbags being tossed at a tiered and collapsible target structure.

Background

Various games are known that involve tossing small objects such as beanbags, washers, balls and other projectiles at a target. The physical effort required in many of these games is relatively low, thereby promoting friendly competition in a low-stress environment. Such games, including the popular "corn hole" game, are popular at outdoor gatherings such as parties, "tailgating," and the like. However, new games are always desired to maintain interest from party-goers.

One game that involves tossing projectiles into a plurality of target buckets is disclosed in U.S. Pat. No. 5,052,693 to Hicks. However, the target apparatus is unwieldy and cannot be dissembled or otherwise adjusted in any way. Because of this, the target apparatus of Hicks cannot be moved or stored easily. Thus, the target apparatus, while presumably suitable for its intended purpose, still suffers from significant drawbacks. Other game apparatuses suffer from similar problems. As a result, a need exists for a new game apparatus and methods of playing games using same.

SUMMARY OF THE PRESENT INVENTION

Some exemplary embodiments of the present invention may overcome one or more of the above disadvantages and other disadvantages not described above, but the present invention is not required to overcome any particular disadvantage described above, and some exemplary embodiments of the present invention may not overcome any of the disadvantages described above.

Broadly defined, the present invention according to one aspect is a soft toss game apparatus as shown and/or described.

Broadly defined, the present invention according to another aspect is a soft toss game apparatus, comprising a plurality of tiered buckets.

Broadly defined, the present invention according to another aspect is a soft toss game apparatus, comprising a plurality of telescoping buckets.

Broadly defined, the present invention according to another aspect is a soft toss game apparatus, comprising a collapsible target structure as shown and/or described.

Broadly defined, the present invention according to another aspect is a soft toss game apparatus, including: a collapsible target structure; and a plurality of tossable objects.

In a feature of this aspect, the collapsible target structure includes a plurality of buckets. In other features, the buckets are concentric; or the tops of the buckets are disposed at tiered heights.

Broadly defined, the present invention according to another aspect is a game utilizing a soft toss game apparatus, as shown and/or described.

Broadly defined, the present invention according to another aspect is a method of playing a game utilizing a soft toss game apparatus as shown and/or described.

Broadly defined, the present invention according to another aspect is a method of playing a soft toss game utilizing a target structure, comprising steps shown and/or described herein.

In a feature of this aspect, the steps include steps and/or follow rules described with regard to the "Bulzi Bag™" game version set forth herein.

In another feature of this aspect, the steps include steps and/or follow rules described with regard to the "BulziPro™" game version described herein.

In another feature of this aspect, the steps include steps and/or follow rules described with regard to the "BulziAssist™" game version described herein.

In another feature of this aspect, the steps include steps and/or follow rules described with regard to the "Advanced Bulzi Assist" game version described herein.

In another feature of this aspect, the steps include steps and/or follow rules described with regard to the "BulziBucket" game version described herein.

In another feature of this aspect, the steps include steps and/or follow rules described with regard to the "Bulzi Hacky Circle™" game version described herein.

In another feature of this aspect, the steps include steps and/or follow rules described with regard to the "Bulzi Pool™" game version described herein.

Broadly defined, the present invention according to another aspect is a soft toss game apparatus, comprising a plurality of bucket compartments stacked on top of one another and structurally attached together for gameplay.

Broadly defined, the present invention according to another aspect is a soft toss game apparatus, including: a plurality of tossable objects; and a collapsible target structure, the target structure including a plurality of bucket components, wherein: each bucket component includes an outer wall, a bottom surface, and an open area at the top of the outer wall that is large enough to receive any of the plurality of tossable objects when tossed by a user; the open area at the top of each bucket component is different in size from that of the other bucket components, with the difference being at least large enough to accommodate the size of the tossable objects; in a first state, the bucket components are assembled in a stack such that, for each lower bucket component having an upper bucket component directly above it, the lower bucket component extends laterally beyond the upper bucket component such that sufficient open area is provided between an outer periphery of the top of the lower bucket and an outer periphery of the bottom surface of the upper bucket component; and in a second state, the bucket components are dissembled from the stack and repositioned such that the bucket components are nested within one another.

In a feature of this aspect, the outer wall of each bucket component is flared outward such that an area defined by the top of the outer wall is larger than an area defined by the bottom of the outer wall. In a further feature, each lower bucket includes an inner wall that is spaced apart from the outer wall, and wherein the inner wall is flared inward away from the outer wall.

In another feature of this aspect, each lower bucket further includes an inner wall that is spaced apart from the outer wall, and wherein the open area at the top of the bucket is defined as the open area between the outer wall and the inner wall. In further features, the bottom surface of each lower bucket component includes a first portion between the outer wall and the inner wall and wherein the inner wall surrounds a second portion of the bottom surface; the inner wall of each lower bucket component includes a top, and wherein each lower bucket component further includes a top surface extending between and within the top of the inner wall; the top surface of each lower bucket component includes a first interlocking structure, wherein the bottom surface of each upper bucket component includes a second interlocking structure, and wherein, in the stacked state, each respective first interlocking structure couples with a corresponding second interlocking structure to maintain the target structure in such stacked state; each of either the first interlocking structures or the second interlocking structures includes a finger lock, and wherein the other of the first interlocking structures or the second interlocking structures includes a slot within which the finger lock is inserted; the inner wall of each lower bucket component includes a top where a first channel structure is disposed, wherein the outer wall of each upper bucket component includes a bottom where a second channel structure is disposed, and wherein, in the stacked state, the first channel structure of each lower bucket component is interlocked with the second channel structure of the upper bucket directly above it to maintain such upper bucket component in place on top of the lower bucket component; the first channel structure extends around only a portion of the top of the lower bucket component and the second channel structure extends around only a portion of the bottom of the upper bucket component such that the upper bucket component directly above each lower bucket component may be manipulated relative to such lower bucket component to interlock the first channel structure with the second channel structure; the top of the lower bucket component is circular, the bottom of the upper bucket component is circular, and wherein the upper bucket component directly above each lower bucket component may be rotated relative to such lower bucket component to interlock the first channel structure with the second channel structure; the first and second channel structures extend laterally away from their respective walls; the inner wall of each lower bucket component includes a bottom where a third channel structure is disposed, and wherein, in the unstacked state, at least one upper bucket component is arranged such that the second channel structure of such upper bucket component is interlocked with the third channel structure of the lower bucket component directly beneath when the at least one upper bucket is nested within the lower bucket component; in the unstacked state, the uppermost bucket component is inverted and nested within the lower bucket component directly below such upper bucket component to create an enclosed compartment, and wherein the plurality of tossable objects are stored in the enclosed compartment; and/or the first channel structure of the inverted bucket component is interlocked with the third channel structure of the lower bucket component directly below the inverted bucket component when the inverted bucket component is nested within such lower bucket component.

In another feature of this aspect, each bucket component is circular.

In another feature of this aspect, in the stacked state, the bucket components are arranged concentrically in the stack.

Broadly defined, the present invention according to another aspect is a method of playing a soft toss game utilizing a target structure, including the steps of: transporting a collapsible target structure, including a plurality of bucket components, to a desired location, wherein each bucket component includes an outer wall, a bottom surface, and an open area at the top of the outer wall that is large enough to receive any of a plurality of tossable objects when tossed by a player, the open area at the top of each bucket component is different in size from that of the other bucket components, with the difference being at least large enough to accommodate the size of the tossable objects, and during transport, the plurality of bucket components are dissembled from a stack and positioned such that the bucket components are nested within one another; at the desired location, assembling the bucket components in a stack such that, for each lower bucket component having an upper bucket component directly above it, the lower bucket component extends laterally beyond the upper bucket component such that sufficient open area is provided between an outer periphery of the top of the lower bucket and an outer periphery of the bottom surface of the upper bucket component; as part of a particular playing of the soft toss game, tossing, by a first player, out of a number of players that is one or more, a first of the plurality of tossable objects in the general direction of the assembled bucket components, determining a score for the first player based on where the first tossable object lands relative to the assembled bucket components, and repeating the tossing and determining steps until the particular playing of the soft toss game is completed; and thereafter, disassembling the plurality of bucket components from the stack and repositioning the plurality of bucket components such that the bucket components are nested within one another.

In a feature of this aspect, the number of players is four, and the players alternate carrying out the tossing and determining steps until the particular playing of the soft toss game is completed. In a further feature, the step of determining a score includes awarding a number of points to the first player based on which of the bucket components, of the plurality of bucket components in the assembled stack of bucket components, the first tossable object lands in or on.

In a further feature, the method further comprises a step, as part of the particular playing of the soft toss game, of deflecting, by a second player, the first tossable object while the first tossable object is in midair in the vicinity of the assembled bucket components, wherein deflecting the first tossable object by the second player is defined as making contact, by a portion of the second player's body, with the first tossable object. In still further features, the second player deflects the first tossable object toward the assembled bucket components in an attempt to cause the first tossable object to land in or on one or more of the assembled bucket components; the step of determining a score is contingent upon the first tossable object having been deflected into or onto one or more of the assembled bucket components by the second player; the method further includes a step of determining a score for the second player if the first tossable object is deflected into or onto one or more of the assembled bucket components by the second player; the step of deflecting may be carried out multiple times by the second player, in a juggling manner, as part of the second player's attempt to cause the first tossable object to land in or on one or more of the assembled bucket components; the step of determining a score is contingent upon the first tossable object having been deflected at least three times by the second player before the tossable object lands in or on one or more of the assembled bucket components; the second player deflects the first tossable object away from the assembled bucket components in an attempt to prevent the first tossable object from landing in or on one or more of the assembled bucket components; the second player deflects the first tossable object without use of the second player's hands and without use of the second player's arms; and/or each of the plurality of tossable objects is a hacky sack.

In another further feature, the desired location is a body of water; the target structure, when assembled in the stack, is buoyant; the method further comprises a step of placing the assembled stack of bucket components on the surface of the body of water; and the steps of the particular playing of the soft toss game are carried out while the assembled stack of bucket components floats on the surface of the body of water. In still further features, the first player is at least partially immersed in the body of water while carrying out the steps of the particular playing of the soft toss game; each of the plurality of tossable objects is water resistant; and/or each of the plurality of tossable objects is buoyant relative to the body of water.

In another further feature, the collapsible target structure is a first collapsible target structure, the plurality of bucket components are a first plurality of bucket components, and the player is a first player, and the method further includes the steps of: transporting a second collapsible target structure, including a second plurality of bucket components, to the desired location, wherein each bucket component includes an outer wall, a bottom surface, and an open area at the top of the outer wall that is large enough to receive any of a plurality of tossable objects when tossed by a player, the open area at the top of each bucket component is different in size from that of the other bucket components in the second plurality of bucket components, with the difference being at least large enough to accommodate the size of the tossable objects, and during transport, the second plurality of bucket components are dissembled from a stack and positioned such that the bucket components, of the second plurality of bucket components, are nested within one another; at the desired location, assembling the second plurality of bucket components in a stack such that, for each lower bucket component having an upper bucket component directly above it, the lower bucket component extends laterally beyond the upper bucket component such that sufficient open area is provided between an outer periphery of the top of the lower bucket and an outer periphery of the bottom surface of the upper bucket component; as part of the particular playing of the soft toss game, tossing, by a second player, a second of the plurality of tossable objects, which may or may not be the same as the first of the plurality of tossable objects, in the general direction of the second assembled bucket components, and determining a score for the second player based on where the second tossable object lands relative to the second assembled bucket components; and thereafter, disassembling the second plurality of bucket components from the stack and repositioning the second plurality of bucket components such that the bucket components are nested within one another. In still further features, the repeated steps of tossing tossable objects and determining a score are organized into rounds, with a score being determined at the end of each round; the last of the tossable objects to be tossed in each round is scored differently from the scoring for the other(s) of the tossable objects to be tossed in the respective round; and/or in each round, the player attempts to toss the plurality of tossable objects into different bucket components, of the plurality of bucket components, in a particular sequence, and wherein the score determined at the end of the round is based at least in part on the player's success in tossing the objects in the particular sequence.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Further features, embodiments, and advantages of the present invention will become apparent from the following detailed description with reference to the drawings, wherein:

FIG. 8B is a perspective view of one of the three components of the collapsible target structure of FIG. 7;

FIG. 8C is a perspective view of one of the three components of the collapsible target structure of FIG. 7;

FIG. 8E is an enlarged isometric detail of a finger lock;

DETAILED DESCRIPTION

Figure 1:
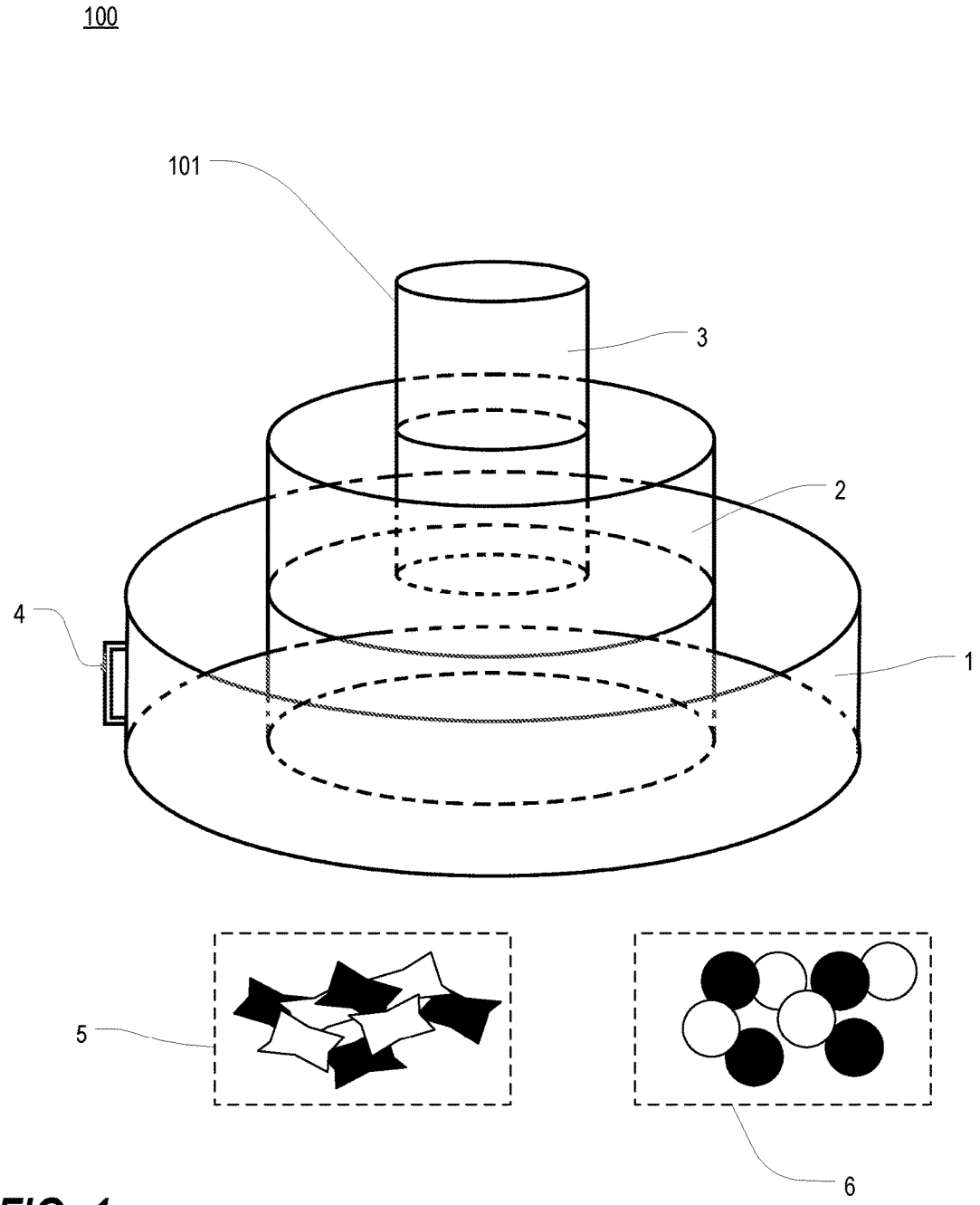
FIG. 1 is a perspective view of a soft toss game apparatus in accordance with one or more preferred embodiments of the present invention.

As a preliminary matter, it will readily be understood by one having ordinary skill in the relevant art ("Ordinary Artisan") that the present invention has broad utility and application. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. As should be understood, any embodiment may incorporate only one or a plurality of the above-disclosed aspects of the invention and may further incorporate only one or a plurality of the above-disclosed features. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Regarding applicability of 35 U.S.C. §112, ¶6, no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers," "a picnic basket having crackers without cheese," and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, in which like numerals represent like components throughout the several views, one or more preferred embodiments of the present invention are next described. The following description of one or more preferred embodiment(s) is merely exemplary in nature and is in no way intended to limit the invention, its application, or uses.

FIG. 1 is a perspective view of a soft toss game apparatus in accordance with one or more preferred embodiments of the present invention. The soft toss game apparatus 100 includes a collapsible target structure 101 and a plurality of beanbags 5, hacky sacks 6, balls, shuttlecocks, or other small objects to be used for tossing at the target structure 101. In at least some embodiments, eight objects of similar size, shape, and design are used, with four of the objects being of one color or decorative appearance and the other four objects being of a different color or decorative appearance. The target structure 101 includes a plurality of collapsible bucket components 1,2,3 and a handle 4 to assist with transportation of the apparatus 100 in a collapsed state. In the illustrated embodiment, there are three buckets 1,2,3, and the handle 4 is attached to the widest bucket component 1. However, it will be appreciated that greater or fewer numbers of bucket components may be used, and that the handle 4 may be located elsewhere or supplemented by one or more additional handles 4.

Figure 2:
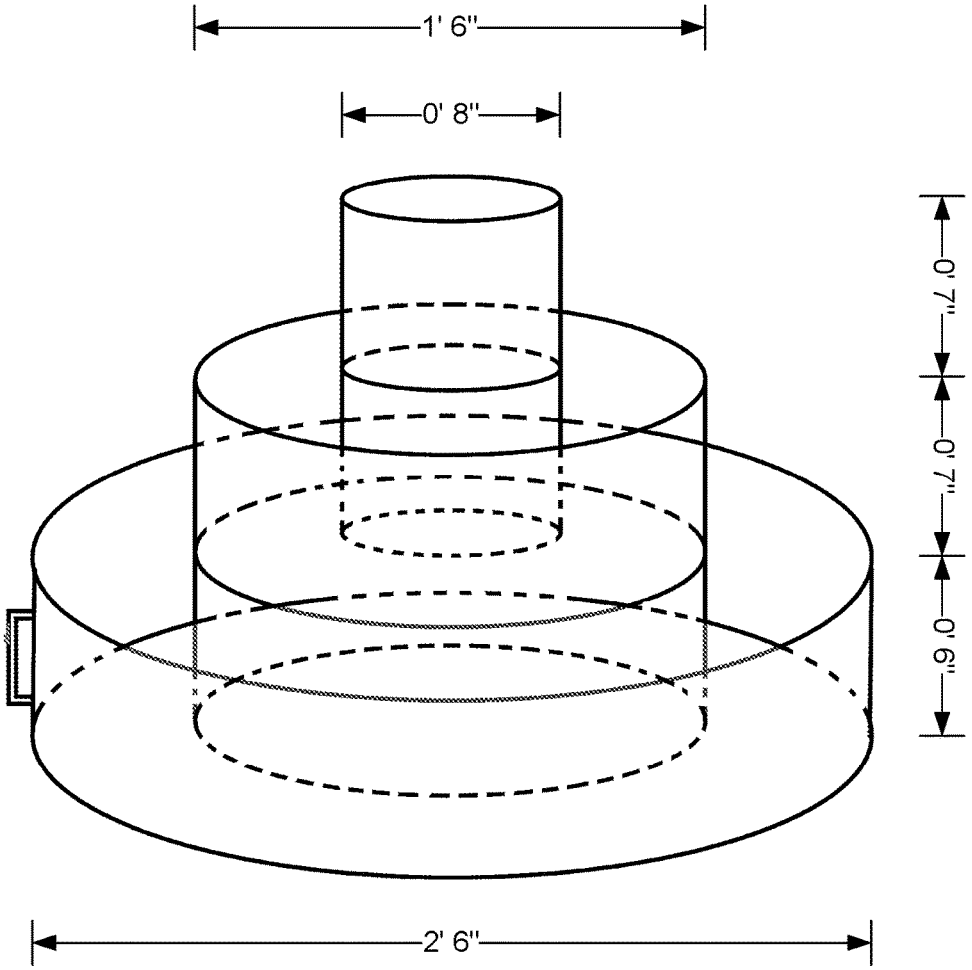
FIG. 2 is a perspective view of the collapsible target structure of FIG. 1, illustrating general dimensions suitable for use in implementing the structure.

FIG. 2 is a perspective view of the collapsible target structure 101 of FIG. 1, illustrating general dimensions suitable for use in implementing the structure. In particular, the top bucket component 3 is 8" wide and 7" tall, the middle bucket 2 is 1'6" wide and 7" tall, and the bottom bucket 1 is 2'6" wide and 6" tall. However, other dimensions may alternatively be used, e.g., buckets 1,2,3 that are 26", 18", and 6" in diameter and 5" or 6" in height. As mentioned previously, one or more handles 4 or hand holes may be provided to facilitate carrying, repositioning, or the like. In some embodiments, such handles 4 may extend outward from the periphery of the widest bucket 1, as shown. In other embodiments, such handles 4 may be built-in, may include recesses or holes that may be gripped, or the like. The location of such handles is preferably related to the structural rigidity of the structure 101, how much deflection will be caused when the structure 101 is being held with the beanbags 5 or other objects inside, and the like.

Figure 3A:
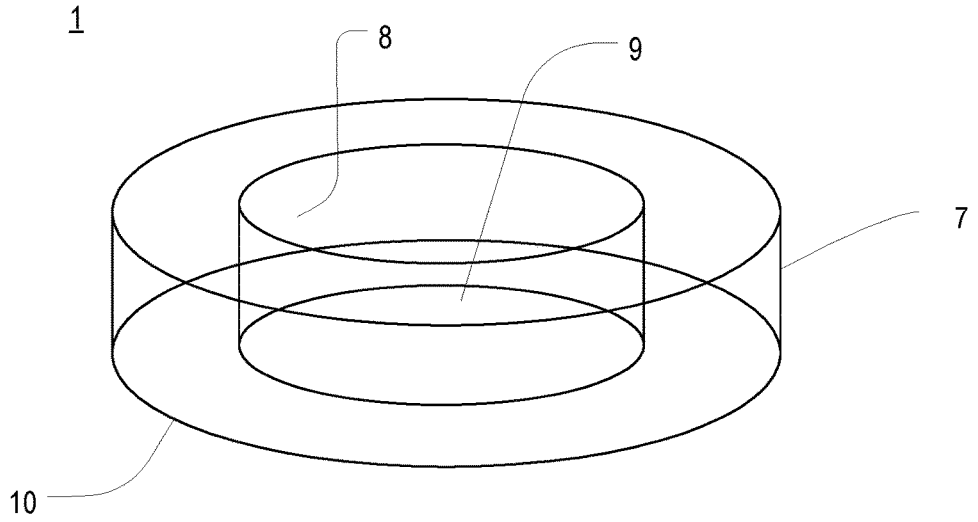
FIG. 3A is a perspective view of one of the three components of the collapsible target structure of FIG. 2.
Figure 3B:
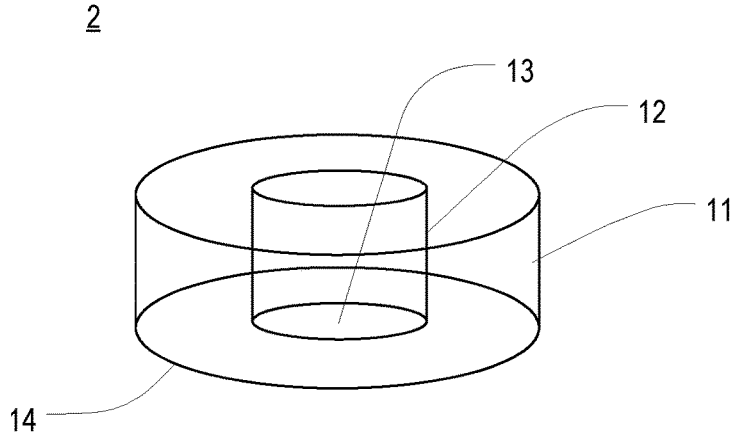
FIG. 3B is a perspective view of one of the three components of the collapsible target structure of FIG. 2.
Figure 3C:
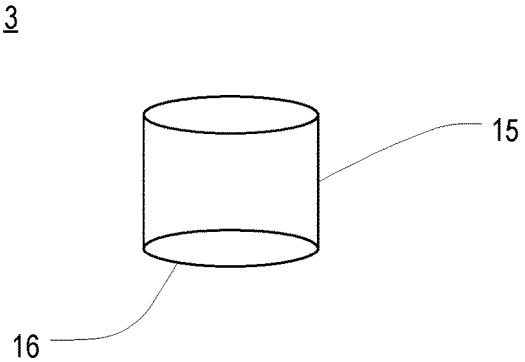
FIG. 3C is a perspective view of one of the three components of the collapsible target structure of FIG. 2.

FIGS. 3A-3C are perspective views of the three components 1,2,3 of the collapsible target structure 101 of FIG. 2. The target structure 101 includes three open buckets 1,2,3 of different widths or diameters. FIG. 3A is a perspective view of the widest, bottommost bucket 1, which includes an inner circular floor 9, an outer donut shaped projectile compartment floor 10, a cylindrical outer wall 7 extending upward from the outer periphery (circumference) of the projectile compartment floor 10, and a cylindrical inner wall 8 extending upward from the outer periphery (circumference) of the inner circular floor 9. FIG. 3B is a perspective view of the middle bucket 2, which likewise includes an inner circular floor 13, an outer donut shaped projectile compartment floor 14, a cylindrical outer wall 11 extending upward from the periphery (circumference) of the projectile compartment floor 14, and a cylindrical inner wall 12 extending upward from the outer periphery (circumference) of the inner circular floor 13. FIG. 3C is a perspective view of the smallest, topmost bucket 3, which includes a circular floor 16 and a cylindrical outer wall 15 extending upward from the periphery (circumference) of the circular floor 16. In at least some embodiments, the various buckets 1,2,3 and their cylindrical walls (inner and outer) are concentric with each other. In at least some embodiments, the buckets 1,2,3 are made of plastic, but in other embodiments the buckets are made of metal, a combination of plastic and metal, or the like.

In some embodiments, the buckets 1,2,3 do not have circular floors (i.e., are not cylindrical), but instead have square, rectangular, diamond-shaped, or oval-shaped floors and correspondingly-shaped walls.

Figure 4:
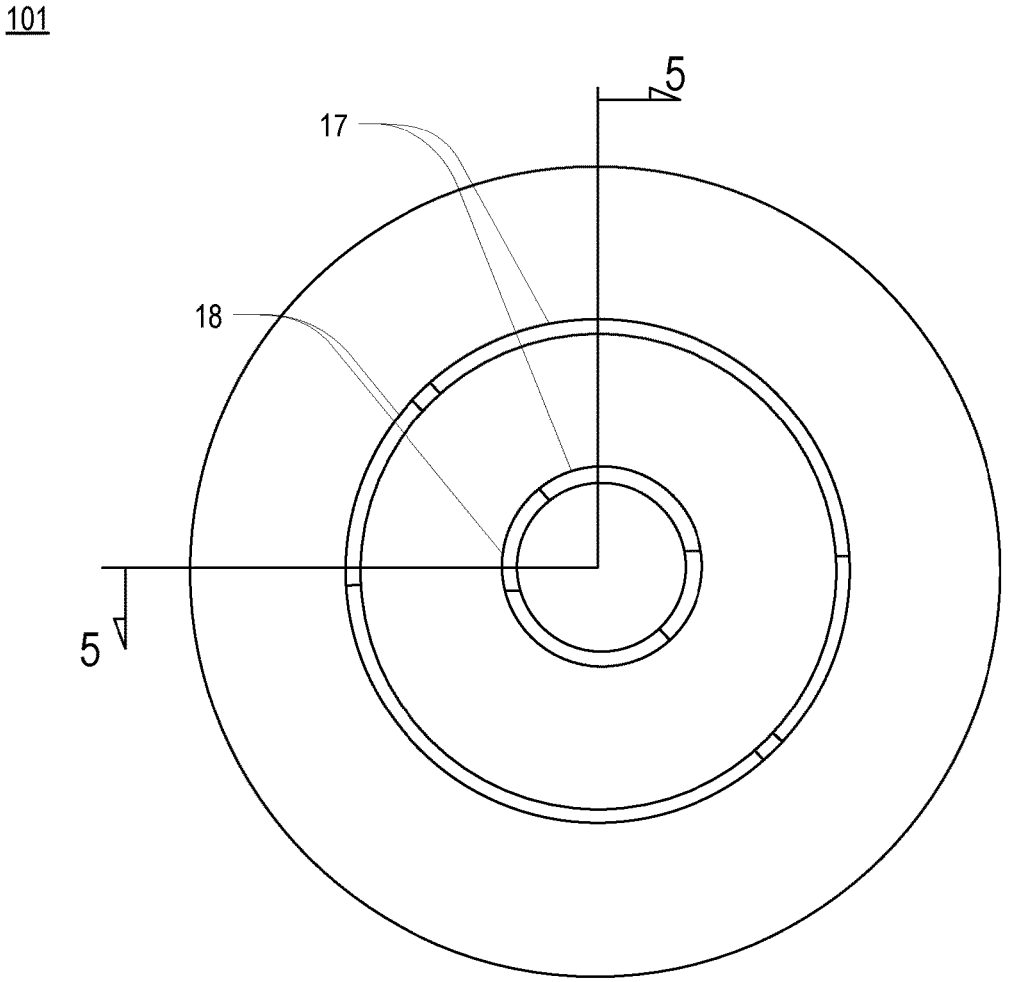
FIG. 4 is a top view of the collapsible target structure of FIG. 2.
Figure 5:
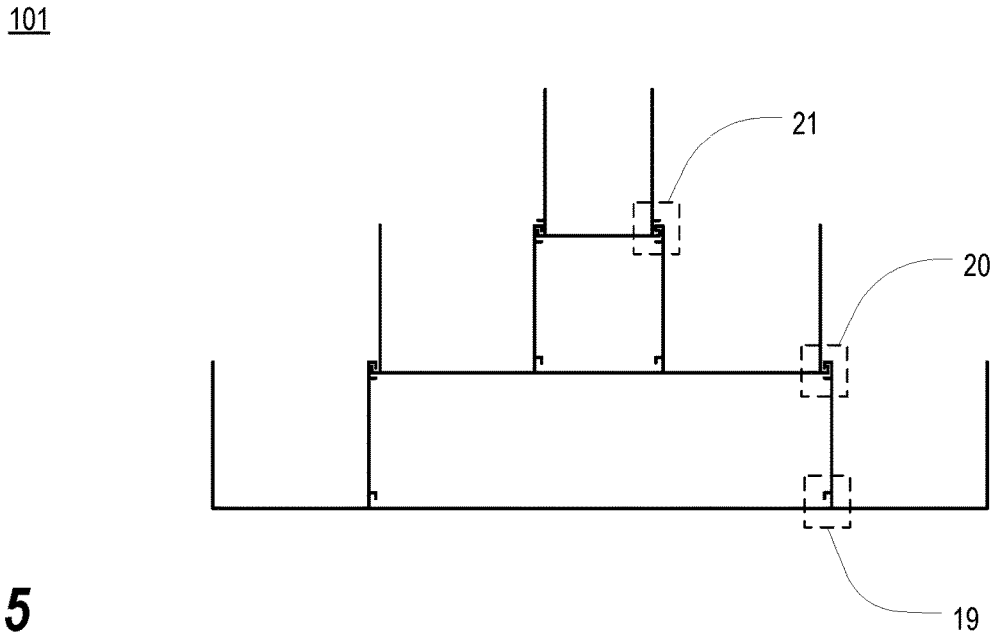
FIG. 5 is a side cross-sectional view of the collapsible target structure of FIG. 4, taken along line 5-5.

FIG. 4 is a top view of the collapsible target structure 101 of FIG. 2, and FIG. 5 is a side cross-sectional view of the collapsible target structure 101 of FIG. 4, taken along line 5-5. As shown collectively therein, channel structures 17 are provided around portions of the top and bottom (inward-facing side) 21,19 of the inner walls 8 of the largest bucket 1, the top and bottom (inward-facing side) of the inner wall 12 of the middle bucket 2, the bottom (outward-facing side) of the middle bucket 20, and the bottom (outward-facing side) of the smallest bucket 21. As perhaps best shown in FIG. 4, channel structures 17 are located around some portions of the various walls 8,12,15, other areas 18 do not include such structures 17. In particular, at least some embodiments have channel structures 17 around less than half of each respective circumference. Thus, a particular bucket 1,2,3 may be separated from another bucket by rotating (twisting) one bucket relative to the other until the channel structures 17 are disengaged, and the smaller bucket may then be lifted from the larger bucket. Conversely, two buckets may be assembled by rotating the channel structures 17 into a separated (disengaged) state and then rotating (twisting) one bucket relative to the other while the respective channel structures 17 engage each other. When the channel structures 17 are fully engaged, the two buckets will remain coupled together.

Figure 6:
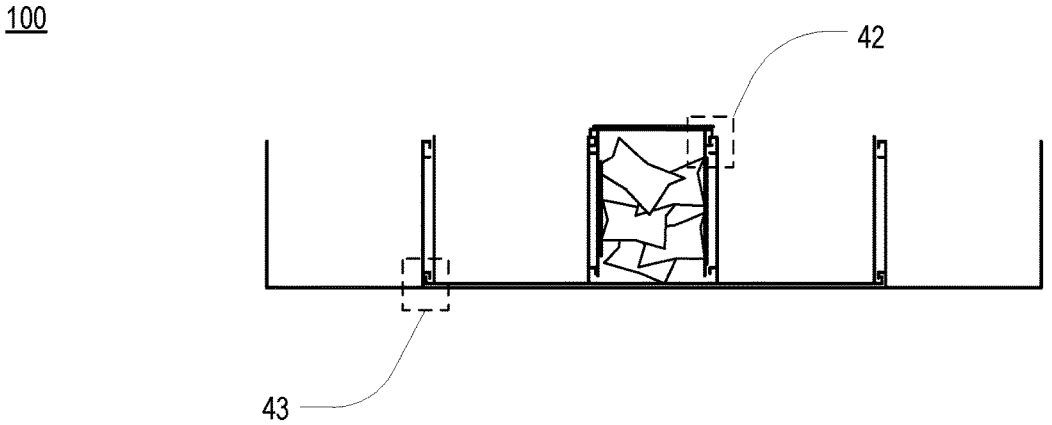
FIG. 6 is a side cross-sectional view of the collapsible target structure of FIG. 5, shown in a collapsed travel state.

FIG. 6 is a side cross-sectional view of the collapsible target structure 101 of FIG. 5, shown in a collapsed travel state. As shown therein, the middle bucket 2 may be lowered to the bottom of the largest bucket 1 and twisted into place such that the channel structures 17 at the bottom of the middle bucket 2 are interlocked with mating channel structures 17 at the bottom of the cylindrical inner wall on the inward-facing side to form an interlocked channel structure 43. The beanbags 5 or other objects may be stored on the floor 13 in the central space inside. The smallest bucket 3 may then be inverted and inserted into the central space of the middle bucket 2, covering and retaining the beanbags 5 or other objects inside. The channel structures 17 at the bottom of the smallest bucket 3 as it appears in FIG. 5 (and is inverted in FIG. 6) are positioned so that they can be rotated into engagement with the channel structures 17 at the top of the cylindrical inner wall 12 to form another interlocked channel structure 42. As shown in FIG. 6, the smallest bucket 3 is thus retained in the central space (inside the inner wall 12) of the middle bucket 2, and the beanbags 5 or other objects are contained inside.

Figure 7:
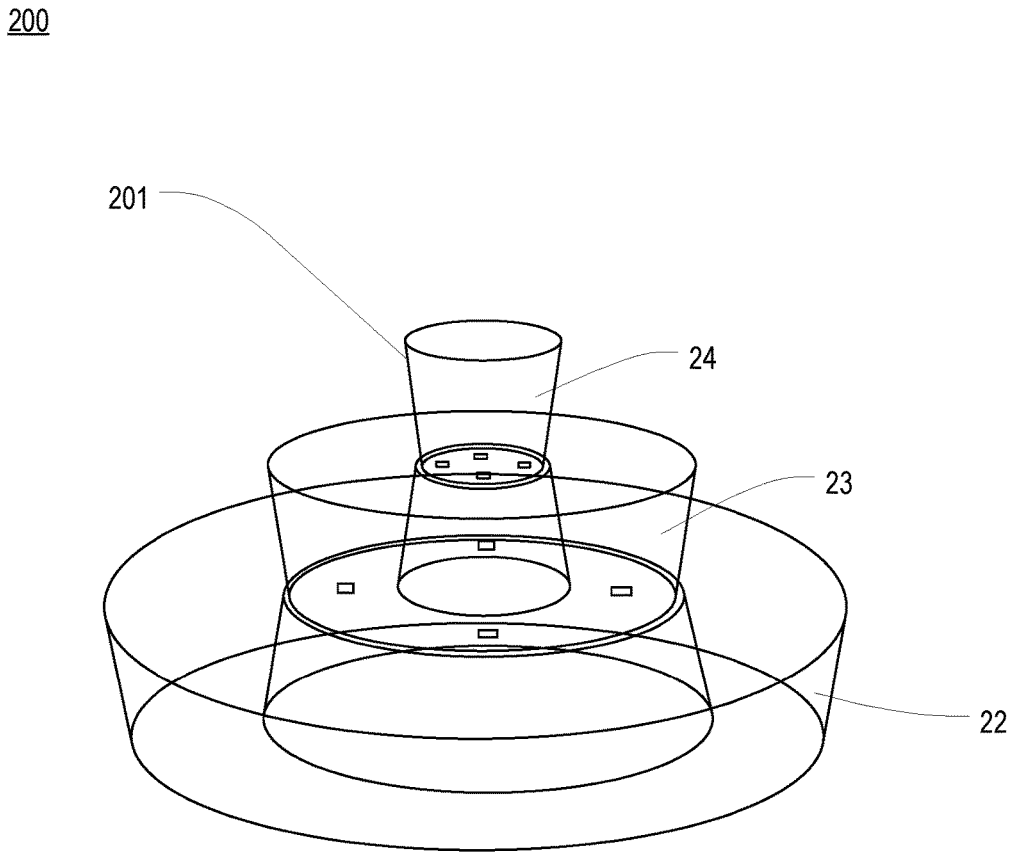
FIG. 7 is a perspective view of a soft toss game apparatus in accordance with another one of the preferred embodiments of the present invention.

FIG. 7 is a perspective view of a soft toss game apparatus 200 in accordance another one of the preferred embodiments of the present invention. As shown therein, the soft toss game apparatus 200 has many similarities to the system of FIGS. 1-6, including a collapsible target structure 201 with a plurality of bucket components 22,23,24.

Figure 8A:
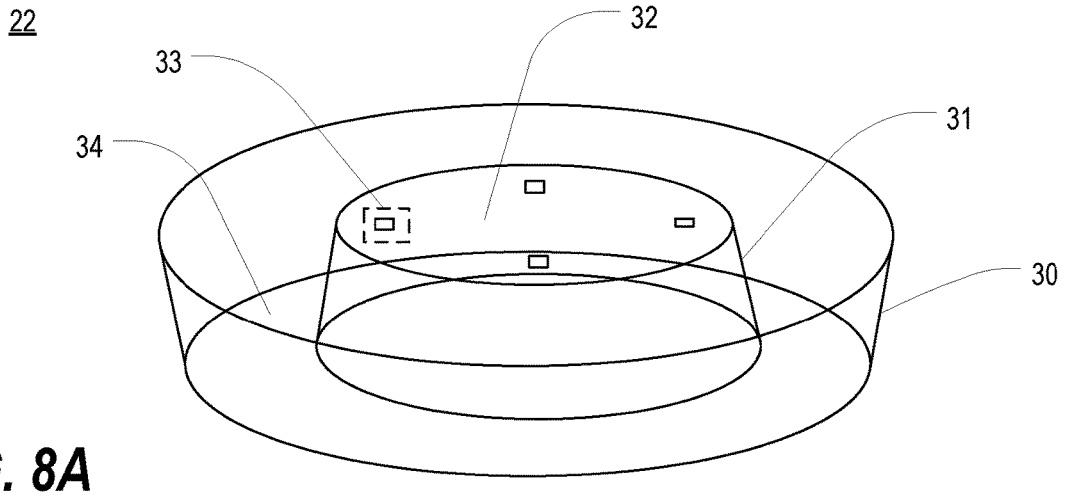
FIG. 8A is a perspective view of one of the three components of the collapsible target structure of FIG. 7.
Figure 8D:
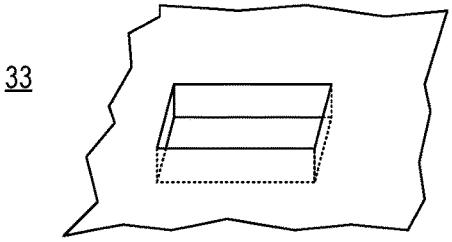
FIG. 8D is an enlarged isometric details of a box slot.

FIGS. 8A-8C are perspective views of the three components 22,23,24 of the collapsible target structure 201 of FIG. 7. The target structure includes three open buckets 22,23,24 of different widths or diameters. FIG. 8A is a perspective view of the largest, bottommost bucket 22, which includes an outer donut shaped projectile compartment floor 34, a circular platform 32 for bucket 23 to rest on, a plurality of box slot openings 33 spaced evenly around the periphery of the circular platform 32, a cylindrical outer wall 30 extending upward and flared outward from the periphery (circumference) of the bucket floor 34, and a cylindrical inner wall 31 extending upward and flared inward from the interior perimeter of the bucket floor 34. In at least one some embodiments, four box slot openings 33 are spaced evenly on the circular platform 32 between the periphery and the center of the platform 32. FIG. 8B is a perspective view of the middle bucket, which likewise includes an outer donut shaped projectile compartment floor 39, a circular platform 38 for bucket 24 to rest on, a plurality of box slot openings 33 spaced evenly around the circular platform 38, a plurality of finger lock projections 35 corresponding to the number of box slot openings 33 on the circular platform 32 spaced evenly around the bucket floor 39, a cylindrical outer wall 36 extending upward, and flared outward from the periphery (circumference) of the bucket floor 39, and a cylindrical inner wall 37 extending upward and inward from the interior perimeter of the bucket floor 39. FIG. 8C is a perspective view of the smallest, topmost bucket 24, which includes a circular floor 41, a plurality of finger lock projections 35 corresponding to the number of box slot openings 33 on the circular platform 38 spaced evenly around the circular floor 41, and a cylindrical outer wall 40 extending upward and flared outward from the periphery (circumference) of the bucket floor 41. FIGS. 8D and 8E are enlarged isometric details of a box slot 33 and finger lock 35 respectively.

Figure 9A:
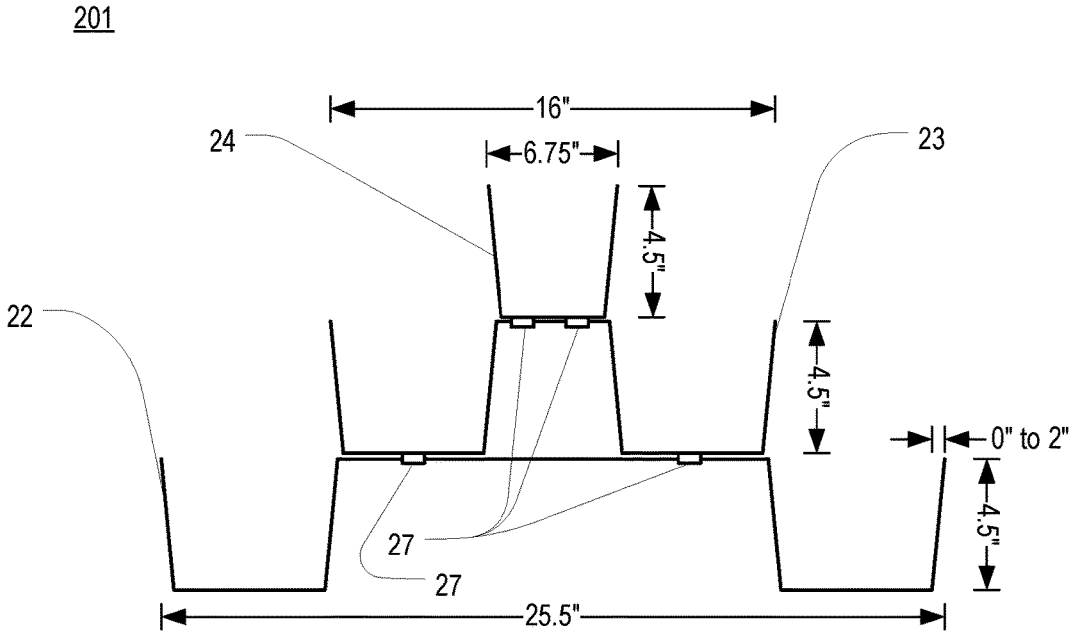
FIG. 9A is a side cross-sectional view of the collapsible target structure of FIG. 7, shown in the game play state.
Figure 9B:
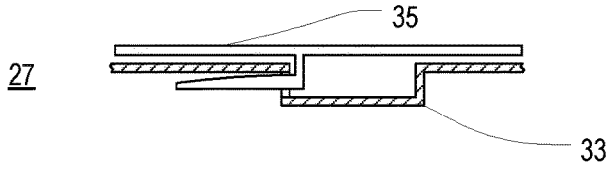
FIG. 9B is a cut section detail of the finger lock and box slot connection for secure structure during game play.

FIG. 9A is a side cross-sectional view of the collapsible target structure 201 of FIG. 7 illustrating general dimensions suitable for use in implementing the structure. As shown therein, the middle bucket 23 rests on platform 32 so that finger locks 35 are of appropriate size to rest inside box slots 33, and be rotated or twisted so that finger locks 35 frictionally grab the platform 32 as to lock buckets into place. FIG. 9B a cut section detail of a finger lock 35 locked inside the box slot 33. Similarly, bucket 24 rests on platform 38 and is twisted into locked position 27. When all three components 22,23,24 are locked together gameplay can begin.

Figure 10A:
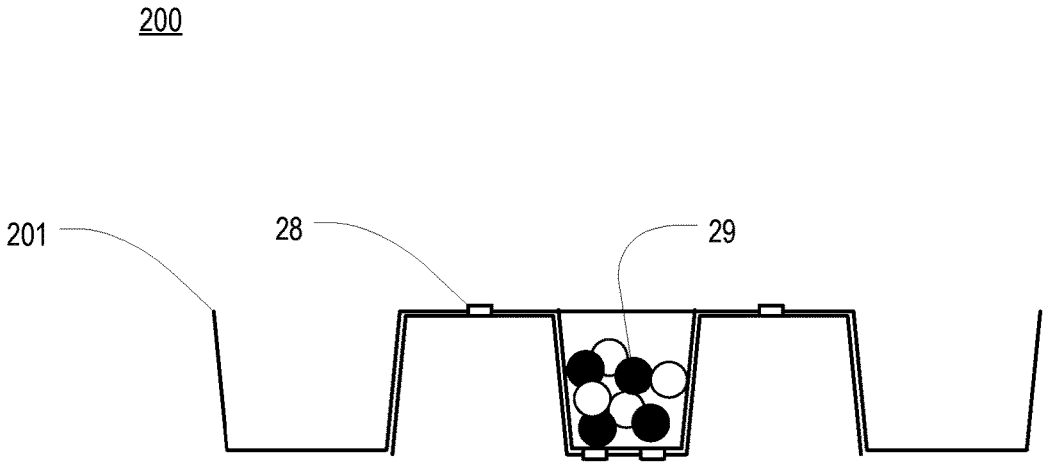
FIG. 10A is a side cross-sectional view of the collapsible target structure of FIG. 7, shown in a collapsed storage and travel state.
Figure 10B:
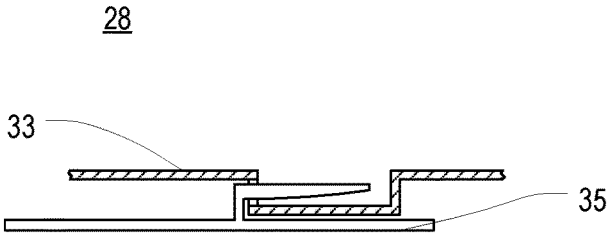
FIG. 10B is a cut section detail of the finger lock and box slot connection for secure structure during storage and transport.

FIG. 10A is a side cross-sectional view of the collapsible target structure 201 of FIG. 7, shown in a collapsed travel state. As shown therein, the middle bucket 23 may be removed from the top and bottom buckets 22,24 and rotated upside down 180 degrees, so that the smallest bucket 24 sits in the concaved area of the underside of the middle bucket 23, and the middle bucket 23 is twisted to lock in place to the box slots 33 on underside of the largest bucket 22. FIG. 10B is a cut section detail of the finger lock 35 and box slot 33 connection 28 to achieve desired collapsed configuration for secure structure during storage and transport. As shown, projectile objects 29 may also be stored in the void of bucket 24 and underside of bucket 22 such that when the interlocked buckets are tilted at least 90 degrees the projectile objects 29 are prevented from escaping.

In other embodiments, the buckets 22,23,24 may be assembled into the state shown in FIG. 7 by snapping the buckets together rather than twisting. The flared aspect of inner and outer bucket walls has been designed to allow for the nesting of buckets 23,24 inside the larger bucket 22 creating a collapsible multi-component structure. As described herein, the "finger lock" 35 and "box slot" 33 aspects allow for the upper two buckets 23,24 to twist and lock into place both during gameplay and storage configurations. It is understood that the "box slot" 33 and "finger lock" 35 details can be accomplished in a number of different design variations and this embodiment is just one of many examples of how bucket components can be locked and unlocked to achieve desired collapsible structure. This is in no way intended to limit the invention, its application, or desired uses. In at least some embodiments, the various buckets and their cylindrical walls (inner and outer) are concentric with each other. In at least some embodiments, the buckets are made of plastic, but in other embodiments the buckets are made of metal, a combination of plastic and metal, or the like.

Figure 11:
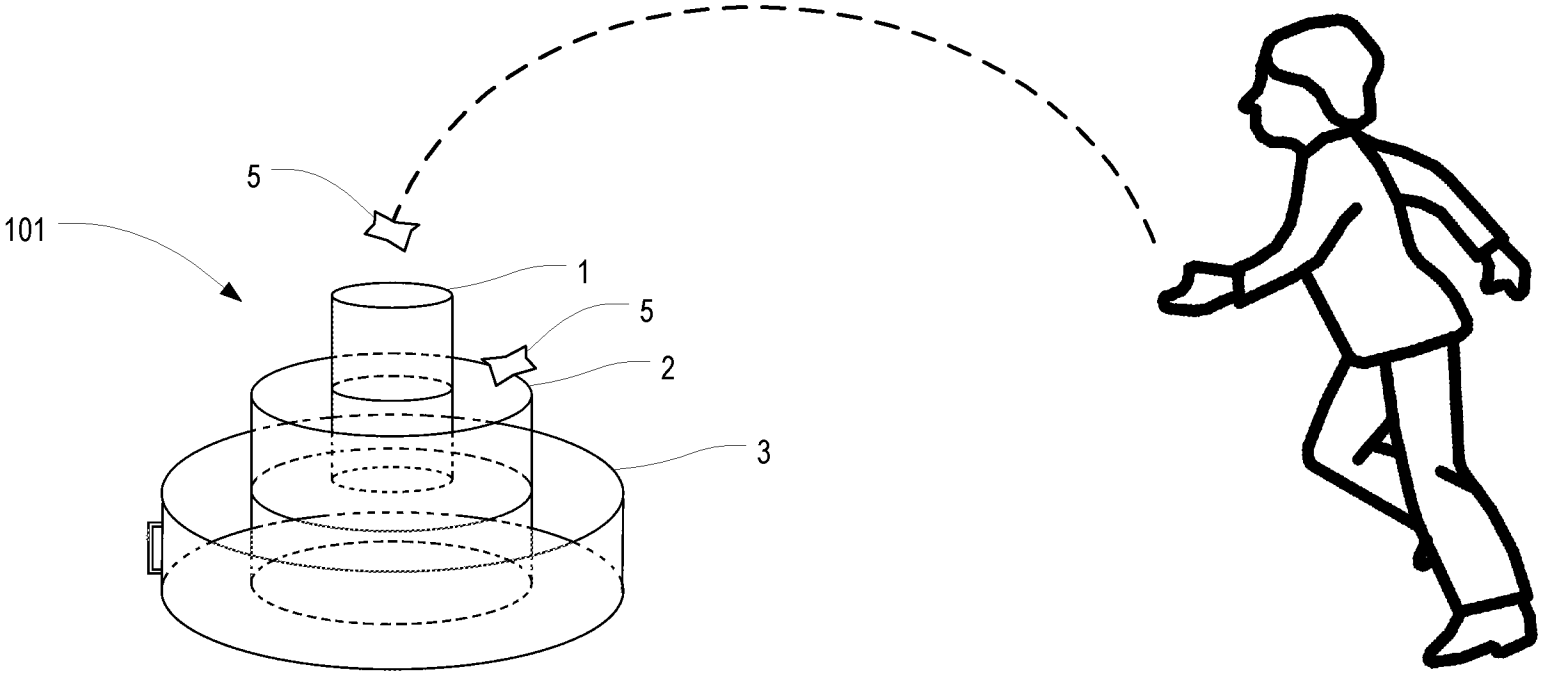
FIG. 11 is a perspective view of a player using the soft toss game apparatus of FIG. 1.

FIG. 11 is a perspective view of a player using the soft toss game apparatus 100 of FIG. 1. The apparatus 100 may be used to facilitate games and other activities in a variety of ways. In one style of game, two or more teams with from one to four players on each team divide the beanbags 5 or other objects such that each team has an equal number of objects. For example, two teams of two players each could each have four beanbags (and could divide the four beanbags evenly among themselves). The objects are provided in at least two different color or decoration schemes so that the objects belonging to one team may be differentiated from those of the other team(s). The most preferred number of players is four, with two players per team, and the most preferred game setup includes two target structures 101, with a member of each team standing behind each target 101. With this setup, each player would be throwing on opposite sides of their teammate. However, other numbers of teams, players, target structures, and relative positions could be varied without departing from the scope of the present invention.

The players behind one collapsible target structure 101 take turns tossing their objects at the opposite target structure 101. Projectiles 5,6 can be tossed in a number of different predetermined or undetermined styles (overhead, underhand, backhand, sidearm, and etc.) according to type of gameplay desired. After a player throws his/her beanbag 5 at the target structure 101, they are awarded points according to which tiered bucket 1,2,3 they land in. For example, in at least some methods of game play, the lower bucket 1 is 1 point, the middle tiered bucket 2 is 2 points and the tall center bucket 3 is 3 points (missing the target is zero points). If beanbags 5 or certain other objects are used, they might land on the lip of a bucket and remain there, as shown in FIG. 11. When this happens, the team tossing the beanbag may be awarded only the points for the bucket tier below where it is hanging. Therefore, if a bag comes to rest on the lip of bucket 1, zero (0) points will be awarded. Teams (players) alternate turns throwing their bags at the target. The last beanbag or other object may be worth double the point value assigned to each bucket tier, and in at least some game versions may be called the "Bulzi Bag." If this bag misses the target, points may be deducted from the team's score. The teams' (players') scores are totaled and the team (player) with the highest points will be awarded a score of the difference between his points in the opposing player's points. For example, if the higher scoring team scores 8 points and the lower scoring team scores 5 points, the higher scoring team would be awarded 8−5=3 points for that round (and the lower scoring team would be awarded zero points). The teams or players may continue playing until one team (player) reaches 21 points (or some other designated total), at which point the game is over and the higher-scoring team or player is declared the winner. A version of a game played using the steps and/or rules described above may sometimes be referred to as a "Bulzi Bag™"-style game.

Figure 12:
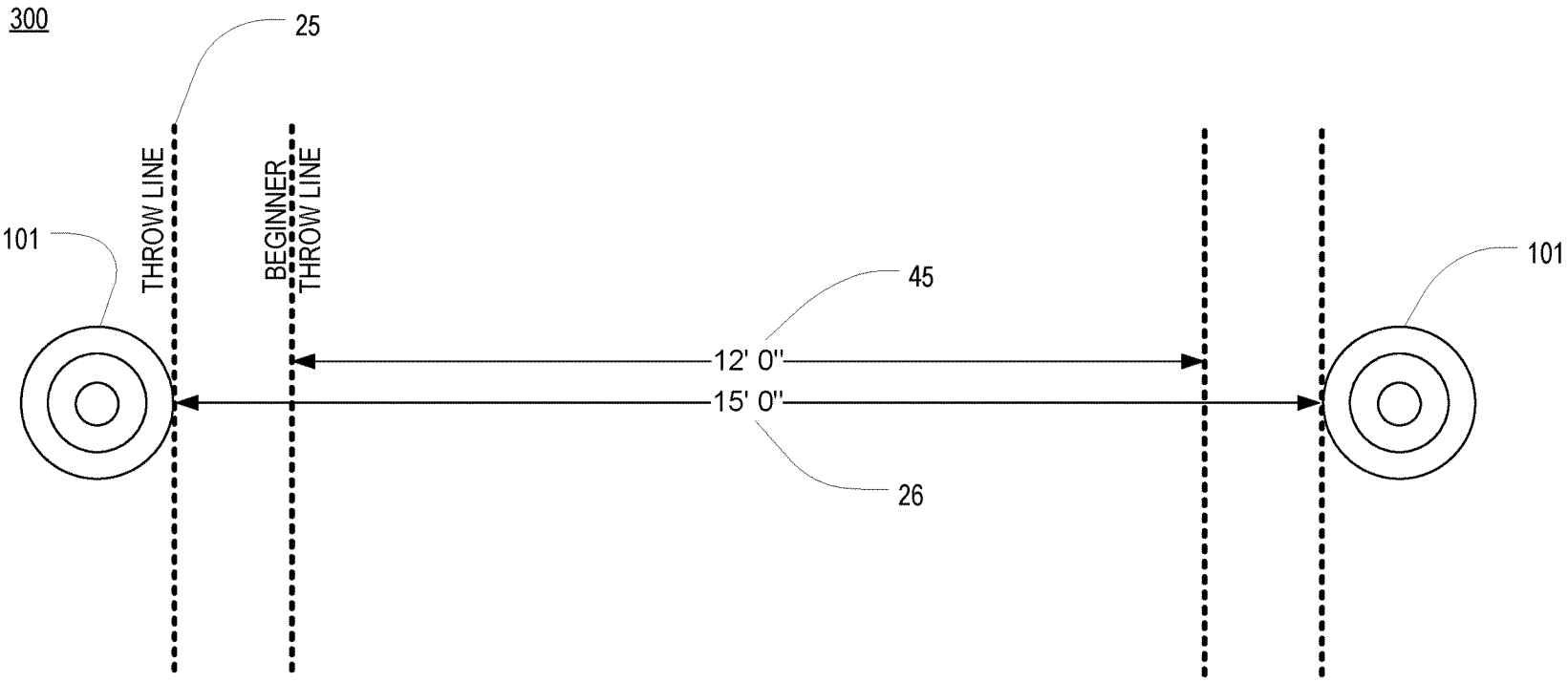
FIG. 12 is an aerial perspective view of a multi target soft toss game apparatus setup consisting of more than one of the collapsible target structures of FIG. 1.

Only one collapsible target structure 101 is utilized in the arrangement shown in FIG. 11. In another version of a game, sometimes referred to as a "traditional" or "BulziPro™"-style game, more than one target structure 101 is utilized. More particularly, the most preferred number of players is four, with two players per team, and the most preferred game setup includes two target structures 101, with a member of each team standing behind each target 101. In this regard, FIG. 12 is an aerial perspective view of a multi target soft toss game apparatus setup 300 consisting of more than one of the collapsible target structures 101 of FIG. 1. With this setup, each player would be throwing on opposite sides of their teammate. However, other numbers of teams, players, target structures, and relative positions could be varied without departing from the scope of the present invention. Setup includes throw lines 25 and recommended target game separation for beginners 45 and advanced players 26. It is understood that the multi target soft toss game apparatus setup 300 can be accomplished with various embodiments of the collapsible target structure 101.

In yet another version of a game, sometimes referred to as a "BulziAssist™"-style game, an additional game play element may be added. In particular, the "BulziAssist"-style rules and style of play are similar to "BulziPro™" rules and style of play but incorporate a unique teammate assist option. This style of play is the currently contemplated commercial version of the product and game play. In this game style, the teammate not throwing the bag may at his/her option deflect the bag with his/her body without using hands/arms into the target. This can be referred to as a "hacky assist" or "juggling assist". The hacky assist is useful for and only allowed when the bag is thrown over or to the side of the target structure 101. The hacky assist may also be used if the bag deflects off the target structure 101. The preferred throwing projectile for this style of play is a hacky sack, but as previously mentioned other objects such as balls, shuttlecocks, rectangular- or other-shaped beanbags or the like could be used.

In at least some methods of play, the "BulziAssist" rules require a "hacky assist" prior to making a bag into the target for points. In other words, the object of this game is to toss to your teammate at the other target. Your teammate will receive the toss by using their body only. Players may juggle the hacky sack as much as they like until they are at a comfortable position to shoot at the target. A still more-advanced version of this style of play requires at least 3 juggles with body/legs/feet prior to being able to shoot the bag into the target. The preferred throwing projectile for this style of play is a hacky sack, but as previously mentioned other objects such as balls, shuttlecocks, beanbags, or the like could be used. A version of a game played using the steps and/or rules described above may sometimes be referred to as an "Advanced Bulzi Assist"-style game.

Yet another method of play, sometimes referred to as the "BulziBucket"-style game, is similar to that of the "BulziPro™" rules, except that a team (player) must land a bag in the bottom bucket 1 (awarding 1 point) before they can be awarded points for making a bag in the middle tier bucket, and must make a bag in the middle bucket 2 (awarding 2 points) prior to being awarded points for making it into the tall center bucket 3 (awarding 3 points). The last (or 4th) bag each round may also be awarded double or negative points, similar to the traditional style of play. The maximum points per round would be 12. This game play may be more appropriate for the more experienced and skilled player.

In yet another method of play, sometimes referred to as the "Bulzi Hacky Circle™" style of play, is performed using only one target structure 101, one hacky sack, and involves four players divided into two teams of two. Players position themselves by surrounding the target structure 101 in a circular fashion. Play is started by serving the hacky sack by throwing a soft lobbed pass or toss to a player's partner who receives the hacky sack with his/her chest/body without using his hands. The object of the game is to "juggle" the hacky sack, without letting it hit the ground, for a predetermined minimum amount of times while allowing both partners to juggle the sack at least once prior to shooting or deflecting the sack into the target for points. If the hacky sack is juggled back and forth twice or more prior to shooting the hacky sack at the target the scoring is worth double the value of the bucket compartment the sack is made into. As used herein, "back and forth twice" would mean a first player serving to his partner (teammate), who receives the sack by juggling it once or more, then passing the sack back to the first player who receives it by juggling once or more, then passing the sack back once more to his partner they juggle once or more, then passing back to the first player a second time before the first player juggles once or more prior to shooting at the target structure 101. The preferred throwing projectile for this style of play is a hacky sack, but as previously mentioned other objects such as balls, shuttle cocks, rectangular shaped beanbags or the like could be used. An alternative version of this game could be played by only two players.

In at least some embodiments, the present invention may also be played in a pool or other water arena. In such embodiments, the target structure 101 will float on its own due to the buoyant design of the bottom bucket 1. This "Bulzi Pool" style of play may be similar to "BulziPro™" style of play and use similar rules but is preferably played with floating target structures 101 and with water resistant, sponge-like or pool-compatible soft toss objects. Preferably, the tossable objects used are also able to float. The players of the "Bulzi Pool" style of play may play while standing inside the pool or standing outside the pool to give options for different variations of play. The most appropriate playing option will be determined by playing participants according to the pool or body of water's dimensions and depth.

It will be appreciated that a wide variety of alternative games may be played, with different point values, goals, or the like. Furthermore, games of "H-O-R-S-E" may be played, or individuals, players, or teams may merely challenge themselves or others to make shots from various distances, locations, or the like.

Based on the foregoing information, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention.

Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements; the present invention being limited only by the claims appended hereto and the equivalents thereof.

What is claimed is:

1. A method of playing a soft toss game utilizing a target structure, comprising the steps of:

transporting a collapsible target structure, including at least three bucket components of three different sizes, including a smallest bucket component, a middle bucket component, and a largest bucket component, to a desired location, wherein:

each bucket component includes an outer wall, a bottom surface, and an open area at the top of the outer wall that is large enough to receive any of a plurality of tossable objects when tossed by a player, the open area at the top of each bucket component is different in size from that of the other bucket components, with the difference being at least large enough to accommodate the size of the tossable objects, and during transport, the at least three bucket components are dissembled from a stack and positioned such that the bucket components are nested within one another with the middle bucket component being mechanically coupled, interconnected, and interlocked directly to the largest bucket component, via respective connection structures on the middle bucket component and the largest bucket component, so as to enable the transporting of the target structure, wherein in such nested, mechanically coupled, interconnected, and interlocked condition, an enclosed compartment is created between the middle bucket component and the largest bucket component, wherein the plurality of tossable objects are stored in the enclosed compartment, and wherein the mechanical coupling, interconnection, and interlocking prevents the middle bucket component and the largest bucket component from separating and thus prevents the tossable objects from escaping the enclosed compartment, even when the, nested, mechanically coupled, interconnected, and interlocked bucket components are tilted back and forth between a first orientation and a second orientation, there being a difference of at least 90 degrees between the first and second orientations;

at the desired location, assembling the bucket components in a stack such that, for each lower bucket component having an upper bucket component directly above it, the lower bucket component is mechanically coupled, interconnected, and interlocked directly to the upper bucket component, via respective connection structures on the lower bucket component and the upper bucket component, and extends laterally beyond the upper bucket component such that sufficient open area is provided between an outer periphery of the top of the lower bucket component and an outer periphery of the bottom surface of the upper bucket component;

as part of a particular playing of the soft toss game:

by a first player, out of a number of players that is one or more, tossing a first of the plurality of tossable objects in the general direction of the assembled bucket components, deflecting, by a second player, the first tossable object while the first tossable object is in midair in the vicinity of the assembled bucket components, wherein deflecting the first tossable object by the second player is defined as making contact, by a portion of the second player's body, with the first tossable object, determining a score for the first player based on where the first tossable object lands relative to the assembled bucket components, and repeating the tossing and determining steps until the particular playing of the soft toss game is completed; and thereafter, disassembling the at least three bucket components from the stack and repositioning the at least three bucket components such that the bucket components are nested within one another and the middle bucket component being mechanically coupled, interconnected, and interlocked to the largest bucket component.

2. The method of claim 1, wherein the number of players is four, and wherein the players alternate carrying out the tossing and determining steps until the particular playing of the soft toss game is completed.

3. The method of claim 2, wherein the step of determining a score includes awarding a number of points to the first player based on which of the bucket components, of the at least three bucket components in the assembled stack of bucket components, the first tossable object lands in or on.

4. The method of claim 3, wherein the method further comprises a step, as part of the particular playing of the soft toss game, of deflecting, by a third player, the first tossable object while the first tossable object is in midair in the vicinity of the assembled bucket components, wherein deflecting the first tossable object by the third player is defined as making contact, by a portion of the third player's body, with the first tossable object.

5. The method of claim 1, wherein the second player deflects the first tossable object toward the assembled bucket components in an attempt to cause the first tossable object to land in or on one or more of the assembled bucket components.

6. The method of claim 5, wherein the step of determining a score is contingent upon the first tossable object having been deflected into or onto one or more of the assembled bucket components by the second player such that zero points are scored by the first player if the first tossable object is not deflected into or onto one or more of the assembled bucket components by the second player.

7. The method of claim 6, further comprising a step of determining a score for the second player if the first tossable object is deflected into or onto one or more of the assembled bucket components by the second player.

8. The method of claim 5, wherein the step of deflecting may be carried out multiple times by the second player, in a juggling manner, as part of the second player's attempt to cause the first tossable object to land in or on one or more of the assembled bucket components.

9. The method of claim 8, wherein the step of determining a score is contingent upon the first tossable object having been deflected at least two times by the second player before the tossable object lands in or on one or more of the assembled bucket components such that zero points are scored by the first player if the first tossable object is not deflected at least two times by the second player before the tossable object lands in or on one or more of the assembled bucket components.

10. The method of claim 4, wherein the second player deflects the first tossable object away from the assembled bucket components in an attempt to prevent the first tossable object from landing in or on one or more of the assembled bucket components.

11. The method of claim 4, wherein the second player deflects the first tossable object without use of the second player's hands and without use of the second player's arms, and wherein the step of determining a score is contingent upon the first tossable object having been deflected into or onto one or more of the assembled bucket components without use of the second player's hands and without use of the second player's arms such that zero points are scored by the first player if the second player's hands or arms are used to deflect the first tossable object into or onto one or more of the assembled bucket components.

12. The method of claim 4, wherein each of the plurality of tossable objects is a ball-shaped footbag.

13. The method of claim 3, wherein:

the desired location is a body of water;

the target structure, when assembled in the stack, is buoyant;

the method further comprises a step of placing the assembled stack of bucket components on the surface of the body of water;

the steps of the particular playing of the soft toss game are carried out while the assembled stack of bucket components floats on the surface of the body of water;

each of the plurality of tossable objects is water resistant; and each of the plurality of tossable objects is buoyant relative to the body of water.

14. The method of claim 13, wherein the first player is at least partially immersed in the body of water while carrying out the steps of the particular playing of the soft toss game.

15. The method of claim 3, wherein the collapsible target structure is a first collapsible target structure, the at least three bucket components are a first set of at least three bucket components, and the player is a first player, and wherein the method further comprises the steps of:

transporting a second collapsible target structure, including a second set of at least three bucket components, to the desired location, wherein:

each bucket component includes an outer wall, a bottom surface, and an open area at the top of the outer wall that is large enough to receive any of a plurality of tossable objects when tossed by a player, the open area at the top of each bucket component is different in size from that of the other bucket components in the second plurality of bucket components, with the difference being at least large enough to accommodate the size of the tossable objects, and during transport, the second set of at least three bucket components are dissembled from a stack and positioned such that the bucket components, of the second set of at least three bucket components, are nested within one another;

at the desired location, assembling the second set of at least three bucket components in a stack such that, for each lower bucket component having an upper bucket component directly above it, the lower bucket component extends laterally beyond the upper bucket component such that sufficient open area is provided between an outer periphery of the top of the lower bucket and an outer periphery of the bottom surface of the upper bucket component;

as part of the particular playing of the soft toss game:

by a second player, tossing a second of the plurality of tossable objects, which may or may not be the same as the first of the plurality of tossable objects, in the general direction of the second assembled bucket components, and determining a score for the second player based on where the second tossable object lands relative to the second assembled bucket components; and thereafter, disassembling the second set of at least three bucket components from the stack and repositioning the second set of at least three bucket components such that the bucket components are nested within one another.

16. The method of claim 3, wherein the repeated steps of tossing tossable objects and determining a score are organized into rounds, with a score being determined at the end of each round.

17. The method of claim 16, wherein the last of the tossable objects to be tossed in each round is scored differently from the scoring for the other(s) of the tossable objects to be tossed in the respective round.

18. The method of claim 16, wherein in each round, the player attempts to toss the plurality of tossable objects into different bucket components, of the at least three bucket components, in a particular sequence, and wherein the score determined at the end of the round is based at least in part on the player's success in tossing the objects in the particular sequence.

19. The method of claim 1, wherein, in the step of disassembling the at least three bucket components from the stack and repositioning the plurality of bucket components such that the bucket components are nested within one another, the middle bucket component and the largest bucket component are mechanically coupled, interconnected, and interlocked by aligning the respective connection structures of the middle bucket component and the largest bucket component and rotating one or both of the middle bucket component and the largest bucket component until the connection structures are engaged, thereby holding the middle bucket component and the largest bucket component in the mechanically coupled, interconnected, and interlocked condition.

20. The method of claim 1, wherein, in the step of assembling the bucket components in a stack, for each lower bucket component having an upper bucket component directly above it, the lower bucket component is mechanically coupled, interconnected, and interlocked directly to the upper bucket component, via the respective connection structures on the lower bucket component and the upper bucket component, by aligning the respective connection structures of the lower bucket component and the upper bucket component and rotating one or both of the lower bucket component and the upper bucket component until the connection structures are engaged, thereby holding the lower bucket component and the upper bucket component in the mechanically coupled, interconnected, and interlocked condition.

* * * * *